US010616958B2

(12) United States Patent
Otosaka

(10) Patent No.: US 10,616,958 B2
(45) Date of Patent: Apr. 7, 2020

(54) HEATING FURNACE

(71) Applicant: Shin-Etsu Chemical Co., Ltd., Tokyo (JP)

(72) Inventor: Tetsuya Otosaka, Gunma (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 367 days.

(21) Appl. No.: 15/636,608

(22) Filed: Jun. 28, 2017

(65) Prior Publication Data

US 2018/0014358 A1 Jan. 11, 2018

(30) Foreign Application Priority Data

Jul. 11, 2016 (JP) ..... 2016-137085
May 18, 2017 (JP) ..... 2017-098645

(51) Int. Cl.

| | |
|---|---|
| ***H05B 3/48*** | (2006.01) |
| ***H05B 3/03*** | (2006.01) |
| ***H05B 3/14*** | (2006.01) |
| ***C21D 9/00*** | (2006.01) |
| ***H05B 3/40*** | (2006.01) |

(Continued)

(52) U.S. Cl.

CPC ..... *H05B 3/145* (2013.01); *C21D 9/0006* (2013.01); *H05B 3/03* (2013.01); *H05B 3/40* (2013.01); *H05B 3/64* (2013.01); *H05B 3/66* (2013.01); *H05B 2203/016* (2013.01)

(58) Field of Classification Search

CPC . H05B 3/03; H05B 3/145; H05B 3/40; H05B 3/62; H05B 3/64; H05B 3/66; H05B 2203/016; C21D 9/0006

USPC ..... 373/27, 28, 29, 30, 36, 37, 38, 41, 69, 373/71, 72, 75, 88, 90, 91, 92, 93, 94, 373/109, 117, 118, 119, 122, 124, 125, 373/126, 127, 128, 129, 130, 131, 132, 373/133, 134, 137, 166

See application file for complete search history.

(56) References Cited

U.S. PATENT DOCUMENTS 4,503,319 A * 3/1985 Moritoki ..... B22F 3/15 373/117
4,549,345 A * 10/1985 Wilsey ..... F27D 11/02 29/611

(Continued)

*Primary Examiner* — Hung D Nguyen
(74) *Attorney, Agent, or Firm* — Hauptman Ham, LLP

(57) ABSTRACT

A heating furnace includes a bolt inserted through an insertion hole in a part of a heater and further inserted into a hole on a tip surface of an electrode rod. A first washer is between a bearing surface of the bolt and one face of the heater. A second washer is between another face of the heater and the tip surface. The relation of: $|L_0 \cdot \alpha_0 - (T_H \cdot \alpha_H + T_B \cdot \alpha_B + T_E \cdot \alpha_E)| \cdot \Delta T \leq 0.15(T_B + T_E)$ is satisfied, where $L_0$ is an interval between the bearing surface and the tip surface, $\alpha_0$ is a linear expansion coefficient (LEC) of the bolt, $T_H$, $T_B$ and $T_E$ are thicknesses of the part, first and second washers and $\alpha_H$, $\alpha_B$ and $\alpha_E$ are their LECs, respectively, and $\Delta T$ is a temperature increment quantity of a part where the heater and the electrode rod are fastened by the bolt.

8 Claims, 2 Drawing Sheets

(51) Int. Cl.
*H05B 3/66* (2006.01)
*H05B 3/64* (2006.01)

(56) References Cited

U.S. PATENT DOCUMENTS

| | | | | | |
|---|---|---|---|---|---|
| 4,755,658 | A * | 7/1988 | Wilsey | ..... | H05B 3/62<br>373/127 |
| 5,965,050 | A * | 10/1999 | Ripley | ..... | H05B 3/64<br>219/545 |
| 2004/0238526 | A1* | 12/2004 | Leycuras | ..... | H05B 3/64<br>219/548 |

* cited by examiner

HEATING FURNACE

CROSS-REFERENCE TO RELATED APPLICATION

This non-provisional application claims priority under 35 U.S.C. § 119(a) from Japanese Patent Application No. 2016-137085, filed on Jul. 11, 2016 and Japanese Patent Application No. 2017-098645, filed on May 18, 2017, the entire contents of which are incorporated herein by reference.

BACKGROUND

Technical Field

The present invention relates to a heating furnace which is used for heating in steps for manufacturing and processing synthetic quartz glass, a step for drawing an optical fiber and the like, and particularly relates to a heating furnace in which a heater and an electrode are bound with each other by a bolt.

Related Art

A carbon heater, which is broadly used in steps for manufacturing and processing synthetic quartz glass, a step for drawing an optical fiber and the like, is made of a graphite material such as isotropic graphite and a C/C composite, and can obtain a temperature of about 1000° C. to about 2500° C. in an inert gas atmosphere.

In order to supply a current to such a heater, it is necessary to connect an electrode to the heater. As a material for the electrode, which has electric conductivity and is not melted nor reacted with inert gas at a high temperature of about 1000° C. to about 2500° C., a graphite material such as isotropic graphite and a C/C composite can be exemplified similarly to the material for the heater.

Further, since a binding means such as a bolt is necessary for connecting the heater and the electrode, and this binding means is also exposed to the high temperature, a graphite material such as isotropic graphite and a C/C composite is generally selected as a material for the binding means, similarly to the materials for the heater and the electrode. Besides, high melting point metal such as tungsten can be selected but is not generally used, because such high melting point metal may be carbonized or nitrided by nitrogen that is used as inert gas depending on its temperature.

In order to increase adhesion between the heater and the electrode and reduce contact resistance therebetween, a washer is generally disposed between the heater and the electrode. Since this washer is required to have electric conductivity, compressive restorability and heat resistance, an expanded graphite sheet satisfying these requirements are often used. Also, a washer is inserted between a bearing surface of the bolt and the heater in order to release concentration of stress applied while fastening the bolt, and an expanded graphite sheet is often used also for this washer. However, since this washer is not necessarily required to have electric conductivity, a material having no electric conductivity such as a ceramic sheet may be used.

In some cases, as rising and falling the temperature of the heater repeatedly, the bolt is loosened or broken. If the bolt is loosened, the contact between the heater and the electrode becomes poor so as to cause a voltage to fluctuate, and if the bolt is further loosened, a spark may be generated between the heater and the electrode so as to generate black smoke, thereby contaminating an inside of the furnace and a heated object considerably. Further, if the bolt is broken, electricity is not conducted at all, or a spark is generated depending on its condition, thereby causing the same result as that in the case of loosening the bolt.

In the case where isotropic graphite that is the same material as that for the heater is used for the bolt, the bolt is likely to be broken. Whereas, in the case of using a bolt made of a C/C composite having high strength to prevent the breaking, the bolt is unlikely to be broken, but is likely to be loosened as rising and falling the temperature repeatedly. In this case, the bolt is necessary to be refastened, and if this refastening is failed, a spark may be generated so as to contaminate the inside of the furnace.

SUMMARY

An object of the present invention is to provide a heating furnace that can maintain a favorable contact condition between a heater and an electrode, which are made of a brittle material such as carbon, over a long period of time.

A heating furnace according to the present invention is a heating furnace, in which a shaft of a bolt is inserted through an insertion hole that penetrates a heater made of a brittle material from one face to another face thereof, and further is inserted into a hole provided on a tip surface of an electrode rod, and the bolt is fastened so as to bind the heater and the electrode rod, the heating furnace including: one or more first washers provided between a bearing surface of the bolt and the one face of the heater, in which the shaft of the bolt is inserted; and one second washer provided between the another face of the heater and the tip surface of the electrode rod, in which the shaft of the bolt is inserted, and satisfying relation of: $|L_0 \cdot \alpha_0 - (T_H \cdot \alpha_H + T_B \cdot \alpha_B + T_E \cdot \alpha_E)| \cdot \Delta T \leq 0.15(T_B + T_E)$, where an interval between the bearing surface of the bolt and the tip surface of the electrode rod is denoted by $L_0$ [mm], a linear expansion coefficient of the bolt in a longitudinal direction is denoted by $\alpha_0$ [/K], a thickness of a part of the heater where the insertion hole is formed is denoted by $T_H$ [mm], a linear expansion coefficient of the heater in the thickness direction is denoted by $\alpha_H$ [/K], a total thickness of the first washer is denoted by $T_B$ [mm], a linear expansion coefficient of the first washer in a thickness direction is denoted by $\alpha_B$ [/K], a thickness of the second washer is denoted by $T_E$ [mm], and a linear expansion coefficient of the second washer in a thickness direction is denoted by $\alpha_E$ [/K], and temperature increment quantity of a part of binding the heater and the electrode rod is denoted by $\Delta T$ [K].

By satisfying the above-described relation, even if rising and falling the temperature repeatedly in use environment, the bolt is not likely to be broken or loosened, whereby the contact condition between the heater and the electrode can be maintained favorably over a long period of time.

In addition, by selecting a material to satisfy the relation of $\alpha_0 > \alpha_H$, it becomes easier to design the heating furnace that satisfies the above-described relational expression.

Further, by selecting isotropic graphite, which has a larger linear expansion coefficient than that of a C/C composite or the like, as the material for the bolt, it becomes easier to design the heating furnace that satisfies the relation of $\alpha_0 > \alpha_H$.

Moreover, by designing the heating furnace to satisfy the relation of $|L_0 \cdot \alpha_0 - (T_H \cdot \alpha_H + T_B \cdot \alpha_B + T_E \cdot \alpha_E)| \cdot \Delta T \leq 0.06(T_B + T_E)$, decrease of the bolt-fastening force caused by the rising and falling of the temperature can be suppressed, whereby the contact condition between the heater and the electrode can be maintained favorably over a long period of time.

DETAILED DESCRIPTION

Figure 1A:
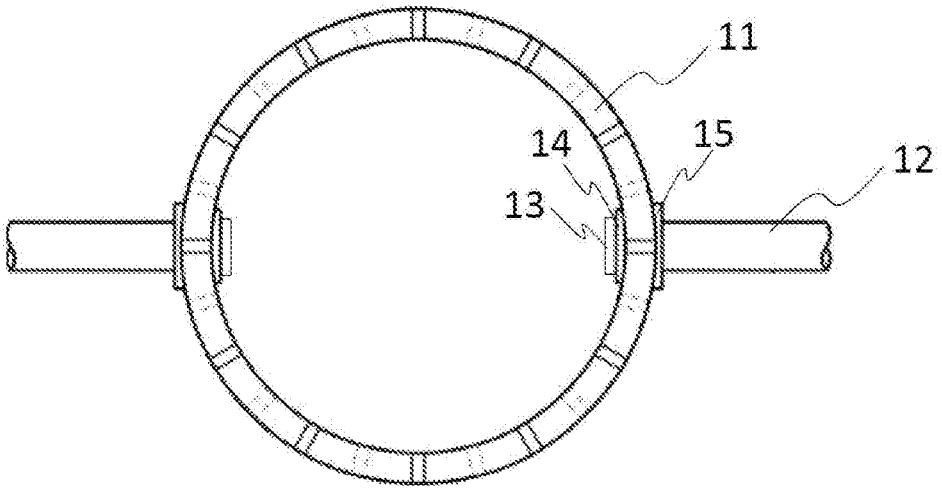
FIG. 1A is a plan view of a heater and an electrode of a heating furnace of the present invention.
Figure 1B:
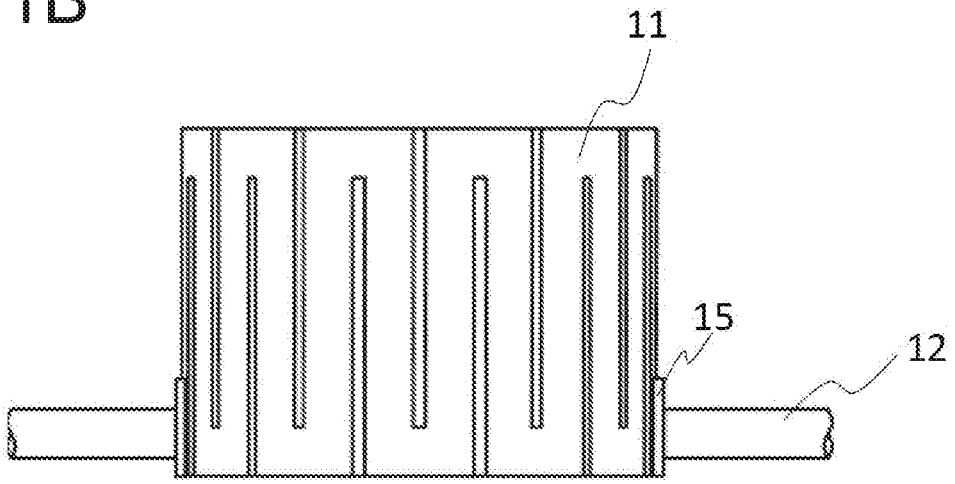
FIG. 1B is a front view of a heater and an electrode of a heating furnace of the present invention.

FIG. 1A and FIG. 1B are schematic views illustrating a structural example of a heating furnace of the present invention. FIG. 1A is a plan view; and FIG. 1B is a front view. The heating furnace of the present invention is provided with a heater 11, an electrode rod 12, a bolt 13, a first washer 14 and a second washer 15.

The heater 11 is a slit heater having a cylindrical shape and slits that are cut from an upper end and a lower end alternately. As a material for the heater 11, a graphite brittle material such as isotropic graphite and a C/C composite is used to obtain a high temperature of 1000° C. to 2500° C. in an inert gas atmosphere. Incidentally, FIG. 1A and FIG. 1B show an example of connecting the electrode rod directly to a side face of the slit heater, but the present invention can be applied to other types of heaters such as a slit heater having a heater terminal extended upward or downward therefrom and a plate heater in a flat shape.

One end of the electrode rod 12 is connected to the heater 11, and another end thereof is connected to a power supply facility, which is not illustrated, so that electric power for heating the heater 11 is supplied to the heater 11. Also as a material for the electrode rod 12, a graphite brittle material such as isotropic graphite and a C/C composite is used.

Figure 2:
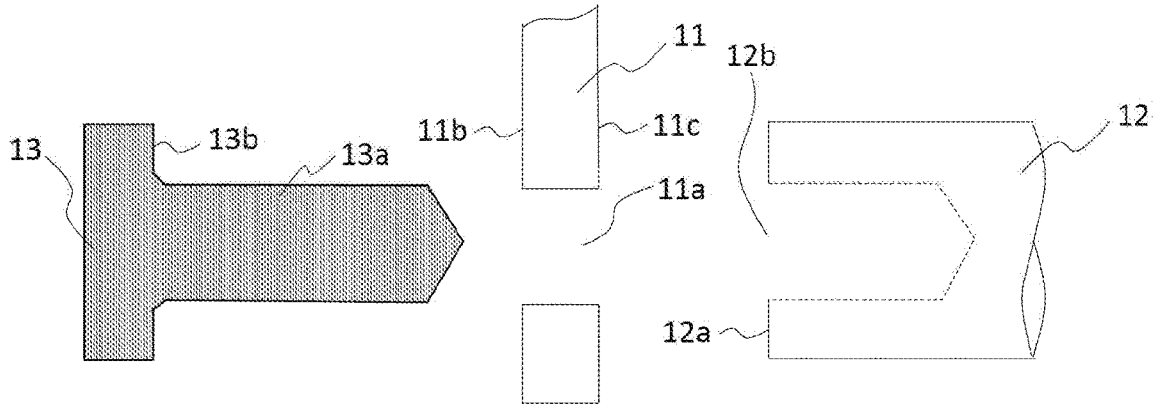
FIG. 2 is a view for explaining machining shapes of the heater and an electrode rod.

As shown in FIG. 2, the heater 11 is provided with an insertion hole 11*a* of the bolt 13 so that the insertion hole 11*a* may penetrate the heater 11 from one face 11*b* to another face 11*c*. A tip surface 12*a* of the electrode rod 12 is provided with a screw hole 12*b* in which a shaft 13*a* of the bolt 13 is inserted and fastened.

Figure 3:
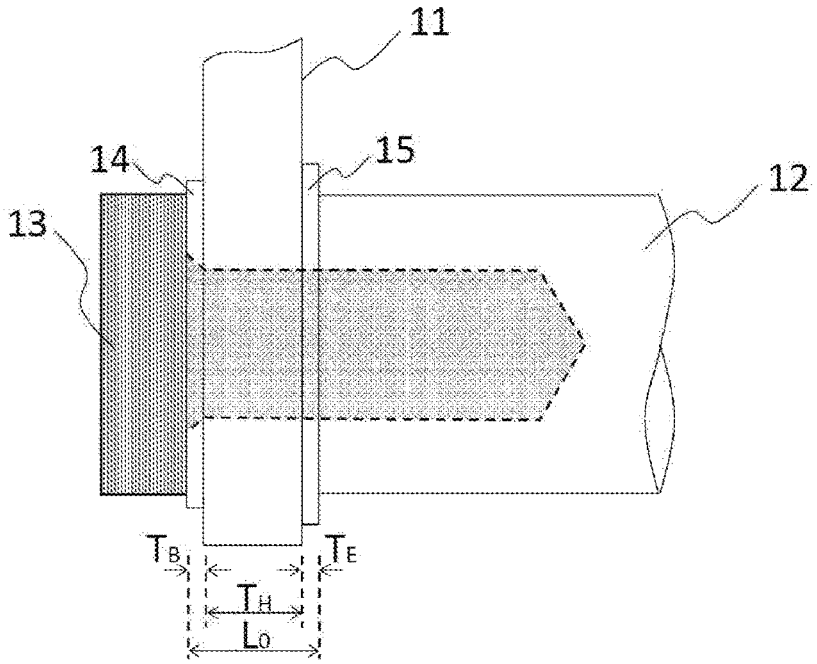
FIG. 3 is an enlarged view of a connected portion of the heater and the electrode rod.

FIG. 3 is a view showing a state of binding the heater 11 and the electrode rod 12 by the bolt 13. Also as a material for the bolt 13, a graphite brittle material such as isotropic graphite and a C/C composite is used.

The shaft 13*a* of the bolt 13 is inserted into the insertion hole 11*a* from the one face 11*b* of the heater 11, and before this insertion, the shaft 13*a* is inserted through the first washer 14. That is, the first washer 14 is sandwiched by a bearing surface 13*b* of the bolt 13 and the one face 11*b* of the heater 11, during the insertion of the shaft 13*a* of the bolt 13. Then, the shaft 13*a* of the bolt 13, which protrudes from the another face 11*c* of the heater 11 by its insertion through the insertion hole 11*a*, is further inserted into the screw hole 12*b* of the electrode rod 12, and before this insertion, the shaft 13*a* of the bolt 13 is inserted through the second washer 15. That is, the second washer 15 is sandwiched by the another face 11*c* of the heater 11 and the tip surface 12*a* of the electrode rod 12 during the insertion of the shaft 13*a* of the bolt 13.

The insertion of the second washer 15 aims to increase adhesion and decrease contact resistance between the another face 11*c* of the heater 11 and the tip surface 12*a* of the electrode rod 12 by absorbing displacement of angles between the respective faces and surface roughness thereof. Herein, it is preferable to insert only one second washer 15, because insertion of a plurality of the second washers 15 is likely to increase fluctuation of the contact resistance per assembly and make distribution of a heating temperature uneven. As a material for the second washer 15, an expanded graphite sheet is preferably used, because electric conductivity, compressive restorability and heat resistance are required.

The insertion of the first washer 14 aims to release concentration of stress to a head of the bolt, which is applied while fastening the bolt. Herein, a plurality of the first washers 14 may be inserted, but the first washer 14 does not have to be inserted, if the bolt 13, a part of the heater 11 where the insertion hole 11*a* is formed and the electrode rod 12 have sufficiently high manufacturing accuracy. As a material for the first washer 14, an expanded graphite sheet is preferably used, but a material having no electric conductivity such as a ceramic sheet may also be used, because electric conduction between the heater 11 and the electrode rod 12 is secured on a side of the another face 11*c* of the heater 11.

The part of the heater 11 where the insertion hole 11*a* is formed, the bolt 13, the first washer 14 and the second washer 15 are expanded thermally according to their linear expansion coefficients, while they are heated. If an interval between the bearing surface 13*b* of the bolt 13 and the tip surface 12*a* of the electrode rod 12 is denoted by $L_0$ [mm], a linear expansion coefficient of the bolt 13 in a longitudinal direction is denoted by $\alpha_0$ [/K], and temperature increment quantity of apart of binding the heater 11 and the electrode rod 12 is denoted by $\Delta T$ [K], substantial stretching of the bolt 13 is represented as $L_0 \cdot \alpha_0 \cdot \Delta T$ [mm]. Whereas, if a thickness of the part of the heater 11 where the insertion hole 11*a* is formed is denoted by $T_H$ [mm], a linear expansion coefficient of the heater 11 in a thickness direction is denoted by $\alpha_H$ [/K], a thickness of the first washer 14 (if using the plurality of the first washers 14, a total thickness of them) is denoted by $T_B$ [mm], a linear expansion coefficient of the first washer 14 in a thickness direction is denoted by $\alpha_B$ [/K], a thickness of the second washer 15 is denoted by $T_E$ [mm], and a linear expansion coefficient of the second washer 15 in a thickness direction is denoted by $\alpha_E$ [/K], an increment by heat in thickness of a member sandwiched by the bearing surface 13*b* of the bolt 13 and the tip surface 12*a* of the electrode rod 12 is $(T_H \cdot \alpha_H + T_B \cdot \alpha_B + T_E \cdot \alpha_E) \cdot \Delta T$ [mm].

By selecting the materials so as to minimize a difference between an elongation of the bolt 13 by heat and an increment by heat in thickness of the member sandwiched by the bearing surface 13*b* of the bolt 13 and the tip surface 12*a* of the electrode rod 12, the break of the bolt 13, the concentration of the stress applied to the first washer 14 and the second washer 15 and generation of gaps between the respective members can be prevented.

In order to select appropriate members, the members shown in Table 1 were combined as appropriate so as to be tested by rising and falling temperatures thereof at $\Delta T$=2000 K ten to fifty times repeatedly and then checking looseness of the bolt and states of washers.

TABLE 1

| Member | Material | Interval or Thickness [mm] | Linear Expansion Coefficient [/K] |
|---|---|---|---|
| Heater (Part where insertion hole is formed) | Isotropic Graphite 1 | $T_H$ = 16 | 4.8E−06 |

TABLE 1-continued

| Member | Material | Interval or Thickness [mm] | Linear Expansion Coefficient [/K] |
|---|---|---|---|
| Bolt | Isotropic Graphite 1 | $L_0 = T_H + T_B + T_E$ | 4.8E−06 |
| | Isotropic Graphite 2 | | 6.2E−06 |
| | C/C Composite | | 4.0E−07 |
| Fast Washer | Expanded Graphite Sheet 1 | $T_B = 0.4$ | 1.0E−04 |
| | Expanded Graphite Sheet 2 | $T_B = 0.38$ | 2.7E−05 |
| Second Washer | Expanded Graphite Sheet 1 | $T_E = 0.4$ | 1.0E−04 |
| | Expanded Graphite Sheet 2 | $T_E = 0\ .38$ | 2.7E−05 |

The looseness of the bolt was evaluated by a value which is obtained by dividing a torque required for loosening the bolt after rising and falling the temperature by a torque required for fastening the bolt when attaching the heater (hereinafter, called as a torque ratio). A torque ratio ranged from 0 to 1, where 0 represents a state where the bolt was completely loosened and bolt axial tension was lost, and a torque ratio closer to 1 represents a state where the bolt axial tension was less changed from its initial state.

Tables 2 to 9 show eight combinations and results of their rising and falling temperature test.

TABLE 2

| | | |
|---|---|---|
| Combination 1 | Bolt | C/C Composite |
| | First Washer | One Expanded Graphite Sheet 1 |
| | Second Washer | One Expanded Graphite Sheet 1 |
| | [A] $L_0 \cdot \alpha_0 \cdot \Delta T$ [mm] | 0.01 |
| | [B] $(T_H \cdot \alpha_H + T_B \cdot \alpha_B + T_E \cdot \alpha_E) \cdot \Delta T$ [mm] | 0.31 |
| | \|[A]-[B]\| | 0.30 |
| | $0.15(T_B + T_E)$ | 0.12 |
| | $0.06(T_B + T_E)$ | 0.05 |
| | State after Rising and Falling Temperature | Torque Ratio ≈ 0 |
| | Twenty Times at ΔT = 2000 K | First Washer Cracked<br>Second Washer Cracked |

TABLE 3

| | | |
|---|---|---|
| Combination 2 | Bolt | C/C Composite |
| | First Washer | One Expanded Graphite Sheet 2 |
| | Second Washer | One Expanded Graphite Sheet 2 |
| | [A] $L_0 \cdot \alpha_0 \cdot \Delta T$ [mm] | 0.01 |
| | [B] $(T_H \cdot \alpha_H + T_B \cdot \alpha_B + T_E \cdot \alpha_E) \cdot \Delta T$ [mm] | 0.19 |
| | \|[A]-[B]\| | 0.18 |
| | $0.15(T_B + T_E)$ | 0.11 |
| | $0.06(T_B + T_E)$ | 0.05 |
| | State after Rising and Falling Temperature | Torque Ratio 0.04 |
| | Twenty Times at ΔT = 2000 K | First Washer<br>Remarkably Crushed<br>Second Washer<br>Remarkably Crushed |

TABLE 4

| | | |
|---|---|---|
| Combination 3 | Bolt | Isotropic Graphite 1 |
| | First Washer | One Expanded Graphite Sheet 1 |
| | Second Washer | One Expanded Graphite Sheet 1 |
| | [A] $L_0 \cdot \alpha_0 \cdot \Delta T$ [mm] | 0.16 |
| | [B] $(T_H \cdot \alpha_H + T_B \cdot \alpha_B + T_E \cdot \alpha_E) \cdot \Delta T$ [mm] | 0.31 |
| | \|[A]-[B]\| | 0.15 |
| | $0.15(T_B + T_E)$ | 0.12 |
| | $0.06(T_B + T_E)$ | 0.05 |
| | State after Rising and Falling Temperature | Torque Ratio 0.05 |
| | Twenty Times at ΔT = 2000 K | First Washer<br>Remarkably Crushed<br>Second Washer<br>Remarkably Crushed |

TABLE 5

| | | |
|---|---|---|
| Combination 4 | Bolt | Isotropic Graphite 2 |
| | First Washer | One Expanded Graphite Sheet 1 |
| | Second Washer | One Expanded Graphite Sheet 1 |
| | [A] $L_0 \cdot \alpha_0 \cdot \Delta T$ [mm] | 0.21 |
| | [B] $(T_H \cdot \alpha_H + T_B \cdot \alpha_B + T_E \cdot \alpha_E) \cdot \Delta T$ [mm] | 0.31 |
| | \|[A]-[B]\| | 0.11 |
| | $0.15(T_B + T_E)$ | 0.12 |
| | $0.06(T_B + T_E)$ | 0.05 |
| | State after Rising and Falling Temperature | Torque Ratio 0.21 |
| | Twenty Times at ΔT = 2000 K | First Washer<br>Slightly Crushed<br>Second Washer<br>Slightly Crushed |

TABLE 6

| | | |
|---|---|---|
| Combination 5 | Bolt | Isotropic Graphite 2 |
| | First Washer | Two Expanded Graphite Sheet 2 |
| | Second Washer | One Expanded Graphite Sheet 2 |
| | [A] $L_0 \cdot \alpha_0 \cdot \Delta T$ [mm] | 0.21 |
| | [B] $(T_H \cdot \alpha_H + T_B \cdot \alpha_B + T_E \cdot \alpha_E) \cdot \Delta T$ [mm] | 0.22 |
| | \|[A]-[B]\| | 0.00 |
| | $0.15(T_B + T_E)$ | 0.17 |
| | $0.06(T_B + T_E)$ | 0.07 |
| | State after Rising and Falling Temperature | Torque Ratio 0.44 |
| | Fifty Times at ΔT = 2000 K | First Washer<br>Slightly Crushed<br>Second Washer<br>Slightly Crushed |

TABLE 7

| | | |
|---|---|---|
| Combination 6 | Bolt | Isotropic Graphite 2 |
| | First Washer | Two Expanded Graphite Sheet 1 |
| | Second Washer | One Expanded Graphite Sheet 1 |
| | [A] $L_0 \cdot \alpha_0 \cdot \Delta T$ [mm] | 0.21 |
| | [B] $(T_H \cdot \alpha_H + T_B \cdot \alpha_B + T_E \cdot \alpha_E) \cdot \Delta T$ [mm] | 0.39 |
| | \|[A]-[B]\| | 0.18 |
| | $0.15(T_B + T_E)$ | 0.18 |
| | $0.06(T_B + T_E)$ | 0.07 |
| | State after Rising and Falling Temperature | Torque Ratio 0.19 |
| | Twenty Times at ΔT = 2000 K | First Washer<br>Slightly Crushed<br>Second Washer<br>Slightly Crushed |

TABLE 8

| | | |
|---|---|---|
| Combination 7 | Bolt | Isotropic Graphite 2 |
| | First Washer | One Expanded Graphite Sheet 2 |
| | Second Washer | One Expanded Graphite Sheet 1 |
| | [A] $L_0 \cdot \alpha_0 \cdot \Delta T$ [mm] | 0.21 |
| | [B] $(T_H \cdot \alpha_H + T_B \cdot \alpha_B + T_E \cdot \alpha_E) \cdot \Delta T$ [mm] | 0.25 |
| | $\lvert[A]-[B]\rvert$ | 0.05 |
| | $0.15(T_B + T_E)$ | 0.12 |
| | $0.06(T_B + T_E)$ | 0.05 |
| | State after Rising and Falling Temperature | Torque Ratio 0.30 |
| | Fifty Times at $\Delta T$ = 2000 K | First Washer Slightly Crushed Second Washer Slightly Crushed |

TABLE 9

| | | |
|---|---|---|
| Combination 8 | Bolt | Isotropic Graphite 2 |
| | First Washer | One Expanded Graphite Sheet 2 |
| | Second Washer | One Expanded Graphite Sheet 2 |
| | [A] $L_0 \cdot \alpha_0 \cdot \Delta T$ [mm] | 0.21 |
| | [B] $(T_H \cdot \alpha_H + T_B \cdot \alpha_B + T_E \cdot \alpha_E) \cdot \Delta T$ [mm] | 0.19 |
| | $\lvert[A]-[B]\rvert$ | 0.01 |
| | $0.15(T_B + T_E)$ | 0.11 |
| | $0.06(T_B + T_E)$ | 0.05 |
| | State after Rising and Falling Temperature | Torque Ratio 0.39 |
| | Fifty Times at $\Delta T$ = 2000 K | First Washer Slightly Crushed Second Washer Slightly Crushed |

In Combination 1, both of the first washer and the second washer were cracked, and the torque required for loosening the bolt was too small to be measured. In Combination 2, both of the first washer and the second washer were remarkably crushed, and the torque ratio was as small as 0.04. In Combination 3, both of the first washer and the second washer were remarkably crushed, and the torque ratio was as small as 0.05. In Combination 4, both of the first washer and the second washer were slightly crushed, and the torque ratio was 0.21, which was larger than those in Combinations 1 to 3, whereby the bolt was not loosened by hand. In Combination 5, regardless of increasing the number of rising and falling the temperature to fifty, both of the first washer and the second washer were slightly crashed, and the torque ratio was 0.44, which means that the bolt was kept to be in a very good state. In Combination 6, both of the first washer and the second washer were slightly crashed, and the torque ratio was 0.19. In Combination 7, regardless of increasing the number of rising and falling the temperature to fifty, both of the first washer and the second washer were slightly crashed and the torque ratio was 0.30, which was favorable. However, the torque ratio is smaller than that in Combinations 5 and 8. In Combination 8, regardless of increasing the number of rising and falling the temperature to fifty, both of the first washer and the second washer were slightly crashed and the torque ratio was 0.39, which was considerably favorable.

From the results of the above-described rising and falling temperature test, it can be concluded that, in the cases of satisfying the relation of $\lvert L_0 \cdot \alpha_0 - (T_H \cdot \alpha_H + T_B \cdot \alpha_B + T_E \cdot \alpha_E)\rvert \cdot \Delta T \leq 0.15(T_B + T_E)$ (in Combinations 4 to 8), the bolt was hardly broken or loosened, so that the contact condition between the heater and the electrode can be maintained favorably over a long period of time. Note that Combination 6 is an example in which the relation of $\lvert L_0 \cdot \alpha_0 - (T_H \cdot \alpha_H + T_B \cdot \alpha_B + T_E \cdot \alpha_E)\rvert \cdot \Delta T = 0.15(T_B + T_E)$) is satisfied. In Combination 6, a symptom of decrease in the torque ratio appears. Because of this, an upper limit of $\lvert L_0 \cdot \alpha_0 - (T_H \cdot \alpha_H + T_B \cdot \alpha_B + T_E \cdot \alpha_E)\rvert \cdot \Delta T$ is suitably about $0.15(T_B + T_E)$.

In the case of satisfying the relation of $\lvert L_0 \cdot \alpha_0 - (T_H \cdot \alpha_H + T_B \cdot \alpha_B + T_E \cdot \alpha_E)\rvert \cdot \Delta T \leq 0.06(T_B + T_E)$ (in Combinations 5, 7 and 8), an effect of suppressing a degradation of the bolt fastening force due to the rise and fall of the temperature and maintaining the favorable contact condition between the heater and the electrode over a long period of time is especially high. Combination 7 is an example in which the relation of $\lvert L_0 \cdot \alpha_0 - (T_H \cdot \alpha_H + T_B \cdot \alpha_B + T_E \cdot \alpha_E)\rvert \cdot \Delta T = 0.06(T_B + T_E)$ is satisfied. In Combination 7, a symptom of slight decrease in the torque ratio appears. Because of this, an upper limit of $\lvert L_0 \cdot \alpha_0 - (T_H \cdot \alpha_H + T_B \cdot \alpha_B + T_E \cdot \alpha_E)\rvert \cdot \Delta T$ is preferable to suitably about $0.06(T_B + T_E)$. Note that $\lvert L_0 \cdot \alpha_0 - (T_H \cdot \alpha_H + T_B \cdot \alpha_B + T_E \cdot \alpha_E)\rvert \cdot \Delta T$ is preferably as small as possible. Combination 5 is an ideal combination in which $\lvert L_0 \cdot \alpha_0 - (T_H \cdot \alpha_H + T_B \cdot \alpha_B + T_E \cdot \alpha_E)\rvert \cdot \Delta T$ is zero.

The design satisfying the above-described relational expression can be realized easily by selecting the materials to satisfy the relation of $\alpha_0 > \alpha_H$. Further, by selecting the isotropic graphite having the larger linear expansion coefficient than that of a C/C composite or the like as the material for the bolt, the relation of $\alpha_0 > \alpha_H$ can be satisfied easily.

The present invention is not limited to the above-described embodiments. As the above-described embodiments are just examples, any forms having substantially the same structures and exhibiting similar effects as those of the technological idea described in the claims of the present invention are embraced in the technical range of the present invention.

What is claimed is:

1. A heating furnace, wherein a shaft of a bolt in the heating furnace is inserted through an insertion hole that penetrates a heater made of a brittle material from one face to another face thereof, and further is inserted into a hole provided on a tip surface of an electrode rod, and the bolt is fastened so as to bind the heater and the electrode rod, the heating furnace comprising:

one or more first washers provided between a bearing surface of the bolt and the one face of the heater, wherein the shaft of the bolt is inserted in the one or more first washers; and one second washer provided between the another face of the heater and the tip surface of the electrode rod, wherein the shaft of the bolt is inserted in the one second washer, and satisfying relation of:

$$\lvert L_0 \cdot \alpha_0 - (T_H \cdot \alpha_H + T_B \cdot \alpha_B + T_E \cdot \alpha_E)\rvert \cdot \Delta T \leq 0.15(T_B + T_E),$$

where an interval between the bearing surface of the bolt and the tip surface of the electrode rod is denoted by $L_0$ [mm], a linear expansion coefficient of the bolt in a longitudinal direction is denoted by $\alpha_0$ [/K], a thickness of a part of the heater where the insertion hole is formed is denoted by $T_H$ [mm], a linear expansion coefficient of the heater in the thickness direction is denoted by $\alpha_H$ [/K], a total thickness of the first washer is denoted by $T_B$ [mm], a linear expansion coefficient of the first washer in a thickness direction is denoted by $\alpha_B$ [/K], a thickness of the second washer is denoted by $T_E$ [mm], and a linear expansion coefficient of the second washer in a thickness direction is denoted by $\alpha_E$ [/K], and temperature increment quantity of a part of binding the heater and the electrode rod is denoted by ΔT [K].

2. The heating furnace according to claim 1, wherein the heating furnace satisfies relation of $\alpha_0>\alpha_H$.

3. The heating furnace according to claim 2, wherein the bolt is made of isotropic graphite.

4. The heating furnace according to claim 3, wherein the heating furnace satisfies relation of:

$$|L_0\cdot\alpha_0-(T_H\cdot\alpha_H+T_B\cdot\alpha_B+T_E\cdot\alpha_E)|\cdot\Delta T\leq 0.06(T_B+T_E).$$

5. The heating furnace according to claim 2, wherein the heating furnace satisfies relation of:

$$|L_0\cdot\alpha_0-(T_H\cdot\alpha_H+T_B\cdot\alpha_B+T_E\cdot\alpha_E)|\cdot\Delta T\leq 0.06(T_B+T_E).$$

6. The heating furnace according to claim 1, wherein the bolt is made of isotropic graphite.

7. The heating furnace according to claim 6, wherein the heating furnace satisfies relation of:

$$|L_0\cdot\alpha_0-(T_H\cdot\alpha_H+T_B\cdot\alpha_B+T_E\cdot\alpha_E)|\cdot\Delta T\leq 0.06(T_B+T_E).$$

8. The heating furnace according to claim 1, wherein the heating furnace satisfies relation of:

$$|L_0\cdot\alpha_0-(T_H\cdot\alpha_H+T_B\cdot\alpha_B+T_E\cdot\alpha_E)|\cdot\Delta T\leq 0.06(T_B+T_E).$$

* * * * *